United States Patent [19]

Boegli et al.

[11] 4,303,080

[45] Dec. 1, 1981

[54] METHOD FOR PRODUCING FILTER CIGARETTES

[75] Inventors: Serge Boegli, Zürich; Jean-Pierre Lebet, Montreux, both of Switzerland

[73] Assignees: F. J. Burrus, Boncourt; Cie and Baumgartner Papier S. A., Crissier, both of Switzerland

[21] Appl. No.: 892,095

[22] Filed: Mar. 31, 1978

[30] Foreign Application Priority Data

Apr. 4, 1977 [CH] Switzerland ..... 4179/77

[51] Int. Cl.[3] ..... A24C 5/52; A24C 5/58; A24D 1/02; A24D 3/18

[52] U.S. Cl. ..... 131/202; 131/58; 131/76; 131/282

[58] Field of Search ..... 131/58–61 B, 131/10 R, 11, 12, 15; 93/1 C, 77 FT

[56] References Cited

U.S. PATENT DOCUMENTS 4,093,496 6/1978 Molins ..... 93/77 FT

*Primary Examiner*—Millin V.

*Attorney, Agent, or Firm*—Ernest F. Marmorek

[57] ABSTRACT

The invention concerns a method for producing a filter cigarette with a filter unit which is provided with a porous or perforated covering strip. A porous or perforated connecting strip joins the tobacco part to the filter unit. The adhesive for connecting the covering strip to the outside of the filter element on the one hand and the adhesive for connecting the connecting strip to the outsides of the filter unit and of the tobacco part on the other hand is applied on those surfaces on the one hand of the covering strip and on the other hand of the connecting strip which are inwardly oriented on the filter cigarette. The adhesive is applied on coating tracks on the sheating strip and on the connecting strip, which said tracks extend so that for any given relative displacement between the said two strips in the longitudinal direction of the filter unit the adhesive coating tracks on the covering strip and on the connecting strip on the other hand always intersect at an angle or at right angles in the radial direction with respect to the longitudinal axis of the filter unit.

21 Claims, 20 Drawing Figures

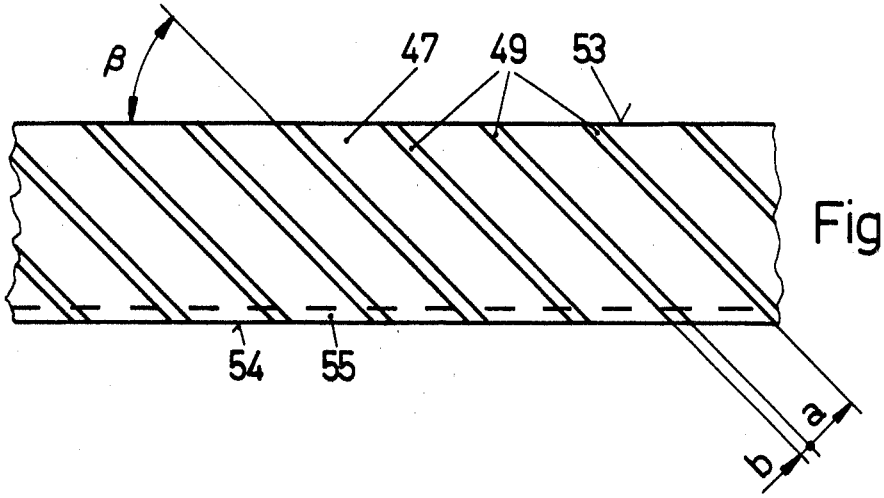
Fig. 15
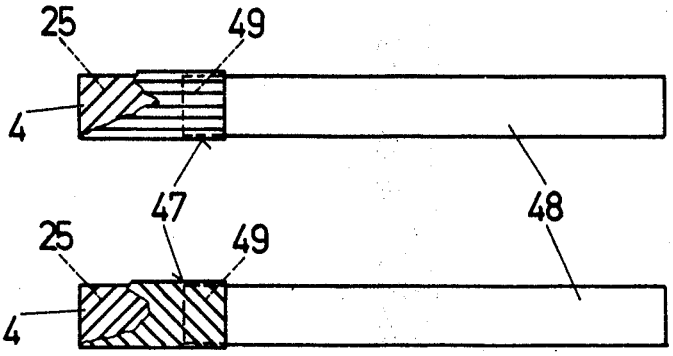
Fig. 16
Fig. 17
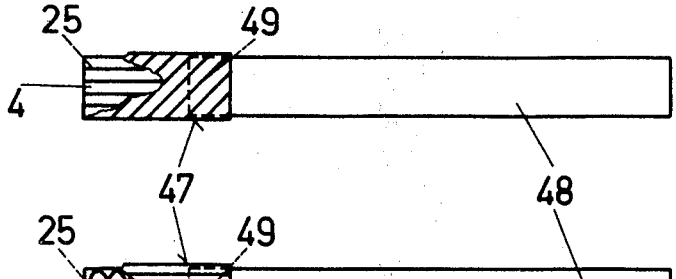
Fig. 18
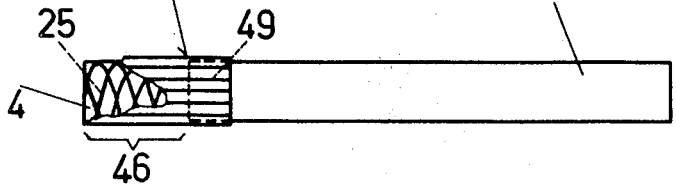
Fig. 19
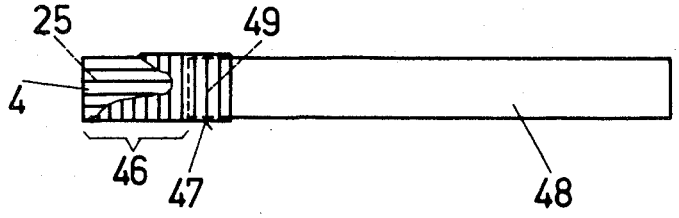
Fig. 20

METHOD FOR PRODUCING FILTER CIGARETTES

The present invention relates to a method for producing a filter cigarette with a filter unit which is provided with a porous or perforated covering strip containing at least one filter element, and a porous or perforated connecting strip which joins the tobacco part to the filter unit, in which the adhesive for connecting the covering strip to the outside of the filter element on the one hand and the adhesive for connecting the connecting strip to the outsides of the filter unit and of the tobacco part on the other hand is applied on the one hand to those surfaces of the covering strip which are inwardly oriented on the filter cigarette and on the connecting strip on the other hand, also apparatus for performing the method and a filter cigarette produced in accordance with this method.

In the production of a filter cigarette with a porous or perforated covering strip and having a filter unit containing at least one plug-shaped filter element and a porous or perforated connecting strip which connects the tobacco part to the filter unit it is known to provide both strips completely with adhesive substance on the side which is inwardly oriented in the finished filter cigarette. This procedure suffers from disadvantages in that after adhesive joining of the covering strip to the filter elements and to the connecting strip with the outside of a filter unit and of the tobacco part a large proportion of the porous or perforated parts of both strips is adhesively joined and air permeability is therefore substantially reduced and secondly the degree of air permeability of the two strips coated in this manner would fluctuate over an excessively wide range from cigarette to cigarette which would make it impossible to state the precise percentage of smoke constituents which would still remain in the cigarette smoke after this flows through the filter unit and is diluted therein.

It is the object of the present invention to provide a method for the production of a filter cigarette with a filter unit which is provided with a porous or perforated covering strip and contains at least one plug-shaped filter element and a porous or perforated connecting strip which connects the tobacco part to the filter unit and in which said filter cigarette dilution of the smoke which flows through the said cigarette portion can be precisely calculated and the degree of dilution achieved in this manner in practice varies only within a very narrow tolerance range so that the smoker cannot detect any difference in smoke dilution between any two random filter cirgarettes produced in this manner.

In a method of the kind described hereinbefore the problem is solved in accordance with the invention in that the adhesive is applied on coating tracks on the sheathing strip and on the connecting strip, which said tracks extend so that for any given relative displacement between the said two strips in the longitudinal direction of the filter unit the adhesive coating tracks on the covering strip on the one hand and the adhesive coating tracks on the connecting strip on the other hand always intersect at an angle or at right angles in the radial direction with respect to the longitudinal axis of the filter unit, that is to say at no place do they extend one above the other or with lateral displacement parallel with each other.

The place where the plug-like filter elements are disposed on the continuously supplied covering strip in the production of the filter units and are connected thereto is completely immaterial in such a procedure and adhesive joining of the connecting strip to the outside of the covering strip does not call for a special arrangement of the connecting strip on the covering strip in order to achieve identical degrees of dilution for all filter cigarettes produced in this manner, a feature which could not hitherto be achieved.

It is convenient that the adhesive is applied to the sheathing strip along coating tracks which are at least approximately equally spaced from each other.

To achieve a simple but nevertheless perfect adhesive join it is advantageous to use a covering strip and/or a connecting strip in which the adhesive substance is applied along coating tracks which extend at an angle to the longitudinal orientation of the cigarette, to which end it is advantageous to use a connecting strip in which the adhesive substance is applied to adhesive coating tracks spaced laterally from each other at a distance so that at any desired place of the connecting strip treated in this manner there will be at least three places of adhesive situated in a plane of observation extending perpendicularly to the longitudinal axis of the cigarette.

To achieve a simple method it is also advantages to use a covering strip in which the adhesive substance is applied along straight lines, more particularly those which extend at an angle $\alpha$ of 45° with respect to the longitudinal orientation of the covering strip. To this end it is advantageous to employ a covering strip in which the adhesive substance is applied along straight lines which extend at an angle $\beta$, more particularly an angle $\beta$ which differs by 90° from the coating angle $\alpha$ employed for the covering strip.

To obtain a useful compromise between efficient adhesive joining and the maximum possible surface area of the covering and connecting strip free of adhesive substance it is advantageous that the lateral spacing of adhesive coating tracks applied on the same portion of the covering strip and/or on the connecting strip is at least three times as large as the width of the adhesive coating tracks.

To obtain an even greater covering paper and/or connecting paper surface area which is free of adhesive substance it is advantageous if the adhesive substance is applied in the form of spots or short lines to the affected paper surface.

It is of course also possible to apply the adhesive substance on the covering strip and/or connecting strip in the form of a plurality of curves, more particularly sinusoidal curves, which are displaced parallel with each other.

The subject of the present invention also relates to apparatus for performing the method according to the invention and is characterized in that the means for applying adhesive to the covering strip, which is moved forward along its longitudinal extent, or to the connecting strip, comprises an applicator roller which is rotatable about its longitudinal axis and is provided on its circumference with adhesive substance receptacles or adhesive substance transfer ribs and the length of the applicator roller corresponds at least to the width of the covering strip or connecting strip.

The subject of the present invention also relates to apparatus for performing the method according to the invention and is characterized in that the means for applying adhesive substance to the covering strip or to the connecting strip comprises a coating system which can reciprocate continuously perpendicularly to the longitudinal orientation of the strip and has exit ports situated at a distance from each other along the longitudinal direction of the continuous forward-moving strip which is provided with adhesive substance along its longitudinal extent.

The subject of the present invention also relates to a filter cigarette produced according to the invention, more particularly a filter cigarette the filter unit of which is provided with a chamber containing free-flowing filter material.

The invention will now be explained by reference to the accompanying drawings in which:

FIG. 15 shows to an enlarged scale a plan view of the connecting strip used in FIG. 14;

FIGS. 16 to 20 show partially sectioned side views of other embodiments of filter cigarettes produced in accordance with the invention.

Figure 1:
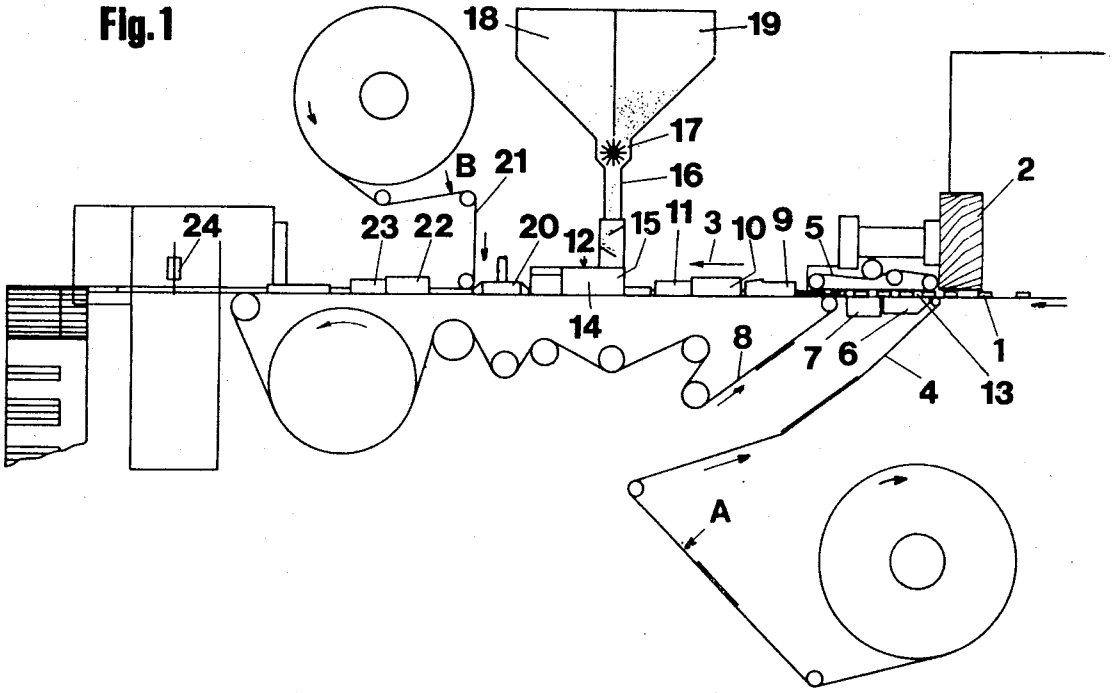
FIG. 1 is a diagrammatic view of the cigarette filter production machine.

As can be seen by reference to FIG. 1 the plug-like filter elements 1, consisting of cellulose or acetate are alternately axially oriented with each other by means of a conveying and distancing device 2 in the illustrated apparatus, are moved forward in the direction of the arrow 3 and are simultaneously equally spaced for the production of chamber filters.

Thereafter the uniformly spaced and axially aligned filter elements 1 are continuously supplied to a likewise continuously supplied covering strip 4, are placed thereon while being laterally guided by guide members and are held in their position relative to each other by means of a presser belt 5 which is disposed above the covering strip 4 and circulates in synchronism therewith and said filter elements are moved forward together with the covering strip 4. As can be seen by reference to FIG. 2 the side of the covering strip 4 nearest to the plug-like filter elements is provided with an adhesive substance which can be softened by heat, for example an adhesive substance based on thermoplastics or a substance known by experts as "hot melt" so that it is possible for the individual filter elements 1 to be affixed to the covering strip 4 by means of a heating element 6 immediately after the elements are transferred to the covering strip 4 so that any relative motion, i.e. any change of their relative distance is rendered impossible. To this end the heating element 6 can be pressed from below against the covering strip 4 ahd can thus be indirectly pressed against the filter elements 1 which are to be affixed. The heating element 6 is arranged so that it is removed from the covering strip 4 when the latter is stationary to prevent burning thereof. After passing over the heating element 6 the covering strip 4 is conducted over a cooling member 7 which is cooled with water so that the adhesive substance coating of the covering strip 4, softened by the heating element 6, solidifies and the filter elements 1 are fixed on the covering strip 4.

After the individual filter elements 1 are fixed on the covering strip 4 the latter is guided to an endless conveyor belt 8 and the parts together pass into a two-part moulding unit 9 in which, in the course of its forward movement, the covering strip 4 of 21 to 22 mm width is wrapped, with the exception of a filling slot of approximately 3 to 4 mm, around the filter elements 1 which have a circumference of 25 mm. By means of the conveyor belt 8 this configuration is first passed under a second heating element 10 which covers the top half of the strand in order to effect complete adhesive joining of the covering strip 4 to the filter elements 1 and to obtain precise fixing of the filter diameter and immediately thereafter is passed under a cooling element 11 which also covers the top half of the strand.

The strand formed in this manner is then conveyed by means of the conveyor belt 8 to a filling part 12, . . . (Swiss patent application No. 15905/75) which said filling part is provided for the introduction of free-flowing filter material, for example activated carbon, into the chambers 13 which are formed between the individual filter elements 1. To increase the charge of the chambers 13 with free-flowing filter material the downwardly oriented discharge side of the storage vessel 14 associated with the filling part 12 is connected (via a sliding member which bears sealingly on the side edges of the covering strip 4 and on the circumferential regions of the filter elements 1 disposed therebetween) with a suction device 15 disposed upstream of the filler aperture of the filling part 12 as seen in the direction of motion of the covering strip 4, and as may also be seen by reference to the above-mentioned patent specification.

The chambers 13 evacuated in this manner then pass beneath the discharge slot which forms the filler opening of the storage vessel 14 whereupon the free-flowing filter material disposed therein is drawn suddenly into the chambers 13 which appear beneath the sliding surface. As can be seen by reference to FIG. 1 the storage vessel 14 communicates through a tube 16 and a metering device 17 with two storage vessels 18 and 19 which are designed for accommodating two different kinds of free-flowing filter material.

After the chambers 13 are filled with free-flowing filter material suction is applied by means of a suction device 20 to the surface regions of the filter elements 1 exposed between the side edges of the covering strip 4 and suction is also applied to the covering strip side edges so that any free-flowing filter material which may be present in these regions is removed and any blackening of the surface regions by such material is avoided.

Figure 3:
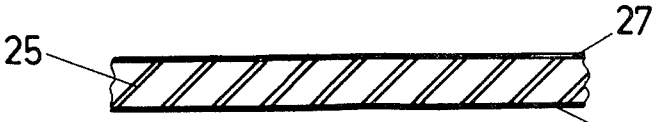
FIG. 3 shows to an enlarged scale a plan view of the direction of the arrow B of FIG. 1 of the closing strip.

Downstream of the suction device 20 a closing strip 21, the width of which is slightly greater than the width of the filling slot, is supplied from above over the filling slot and is adhesively fixed by means of a heatable element 22 on the exposed surface of the filter element 1 and on the side edges of the covering strip 4 by softening of the adhesive substance coating which is applied to the covering strip 24 and is shown in FIG. 3. The heatable element 22 is mounted so that it can be pivoted in the upward direction to enable it to be lifted off the stationary covering strip 21 if the apparatus is shut down.

To obtain a precise external shape for the cigarette filter units the strand, provided with the heated closing strip 21, is passed beneath a water-cooled cooling member 23 where the softened adhesive substance of the closing strip 21 solidifies.

After the filter strand is closed by adhesive joining it is supplied to a cutting device 24 where it is subdivided so that the length of each filter structure amounts to four or six times the length of a single filter of a cigarette to be manufactured.

Figure 2:
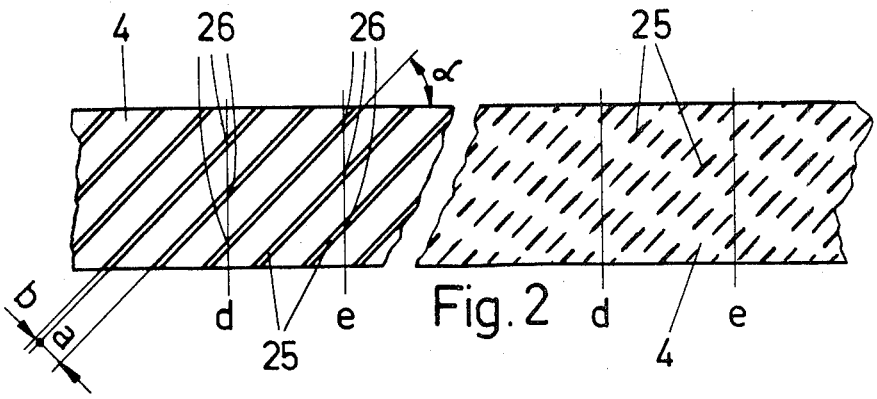
FIG. 2 shows to an enlarged scale a plan view in the direction of the arrow A of FIG. 1 of the covering paper strip.

In the apparatus illustrated in FIG. 1 a covering strip 4, as shown on the left of FIG. 2, of highly porous paper is employed in which the adhesive substance is applied to coating tracks 25 on the covering strip 4 at an angle $\alpha$ of 45° relative to the longitudinal orientation of the covering strip and the coating tracks 25 have a lateral spacing a from each other which is such that at any desired place of the covering strip 4 treated in this manner and along a line of observation d or e extending perpendicularly to the longitudinal orientation of the covering strip there will be at least three adhesive substance places 26. This ensures reliable adhesive joining of the covering strip 4 to the external surfaces of the filter elements 1 without the airpermeability of the covering strip 4 being excessively reduced by the adhesive substance coating tracks 25 and with any step of the cutting device 24 at any desired place of the filter strand the covering strip is always sufficiently adhesively joined to the filter element 1 disposed at the cutting place so that subsequently no defects which could lead to breakdowns are caused in the filter machine during the subsequent connection to the tobacco part of the cigarette.

It has been found advantageous that the lateral spacing a between the adhesive substance tracks 25 be at least three times as large as their width b. In practice it is possible to select a=3 mm and b=1 mm as an example.

As can be seen by reference to the right-hand side of FIG. 2 the adhesive substance can also be applied in the form of spots or short lines on the covering strip 4 and with an arrangement of this kind of the adhesive substance it is important to ensure that there will always be at least three adhesive substance places along any desired line of observation d.

As can be seen from FIG. 3 the closing strip 21 is provided with adhesive substance coating tracks 25 in the same manner as the covering strip 4. To reliably prevent any escape of free-flowing filter material from the chambers 13 which are closed by the closing strip 21 each longitudinal edge thereof is provided with adhesive substance strips 27 and 28 in addition to the adhesive substance tracks 25.

Figure 4:
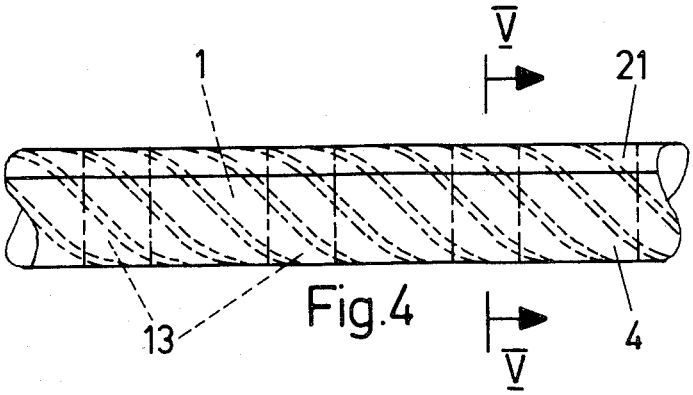
FIG. 4 is a side view of cigarette filter strand produced by means of the machine illustrated in FIG. 1.
Figure 5:
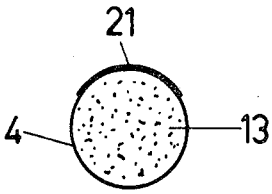
FIG. 5 is a section along the line V—V of FIG. 4.

A side view of part of a completely adhesively joined filter strand is shown in FIG. 4 and the adhesive substance tracks which are not visible from the outside are shown in broken lines. FIG. 5 is a section along the line V—V of FIG. 4.

The covering strip 4 and the closing strip 21 can be provided with adhesive substance in the apparatus illustrated in FIG. 1 after being unreeled from a corresponding supply reel. However, it is of course also possible to provide the strips 4 and 21 with the adhesive substance before the strips are introduced into the device illustrated in FIG. 1 and to store such strips in the form of supply reels.

The term "covering strips" in the claims always refers to the entire covering of the filter unit 46, i.e. in the above-mentioned case it refers to the covering and closing strips 4 and 21 so that the conditions established in the claims for the covering strip refer in the above-mentioned case to the covering and closing strips 4 and 21 which form the filter covering.

If no chamber filter is produced the plug-like filter elements 1, which are then arranged in direct sequence on the covering strip 4, are merely wrapped thereby in which case the width of the covering strip 4 of 27 mm for a filter element circumference of, for example, 25 mm is sufficiently wide to enable the side edges of the covering strip 4 to overlap on the finished filter. To obtain sealing-tight closure of the filter covering it will then be possible to provide adhesive substance along the longitudinal direction on the first side edge of the covering strip which bears externally on the second side edge, i.e. by analogy to the closing strip 21 illustrated in FIG. 3 but in the example only along one side edge.

Figure 8:
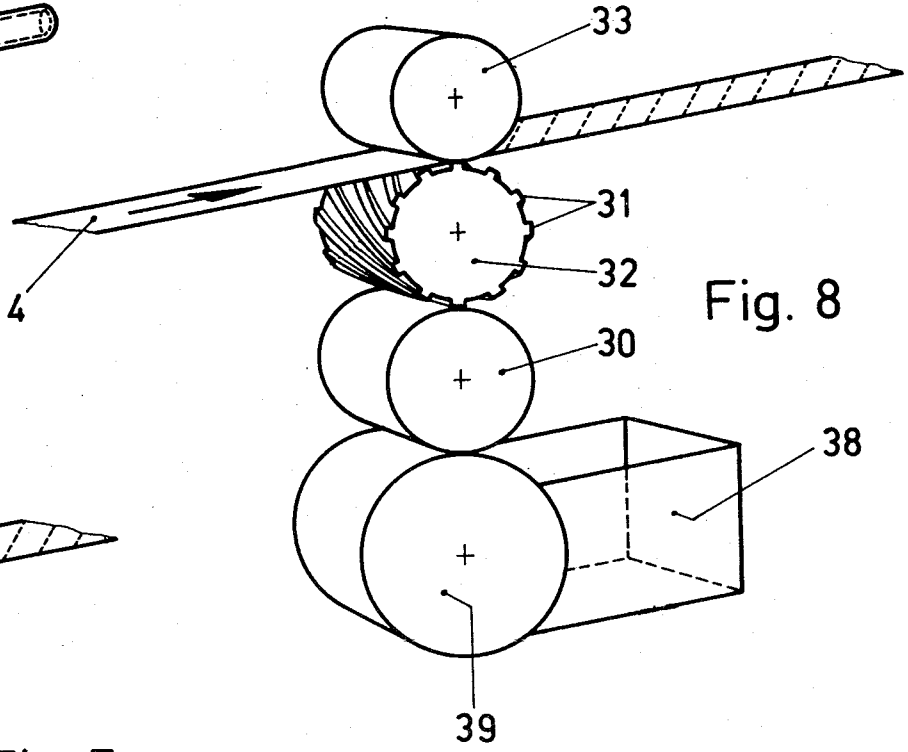
FIG. 8 is a perspective view of a third exemplified embodiment of means for applying adhesive substance to the covering paper strip.
Figure 6:
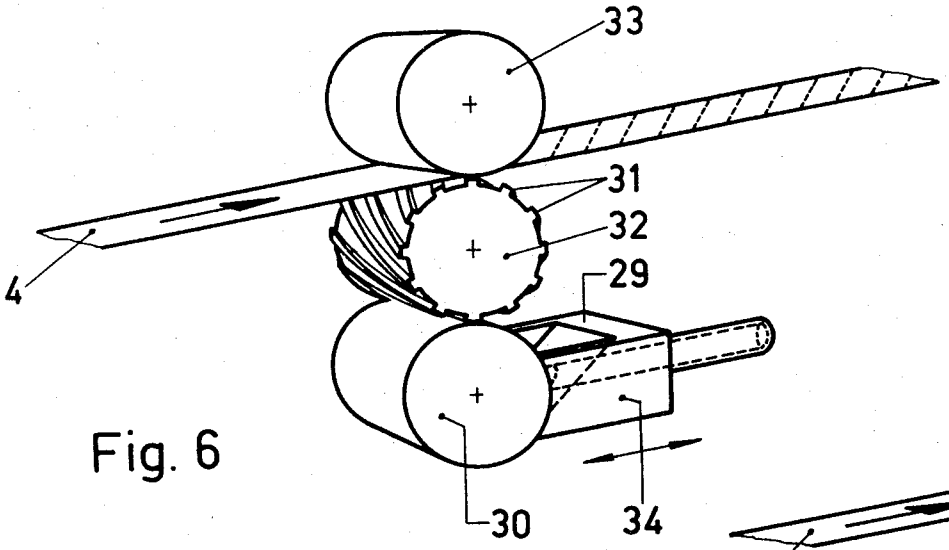
FIG. 6 is a perspective view of a first exemplified embodiment of apparatus for applying adhesive substance to the covering paper strip.
Figure 7:
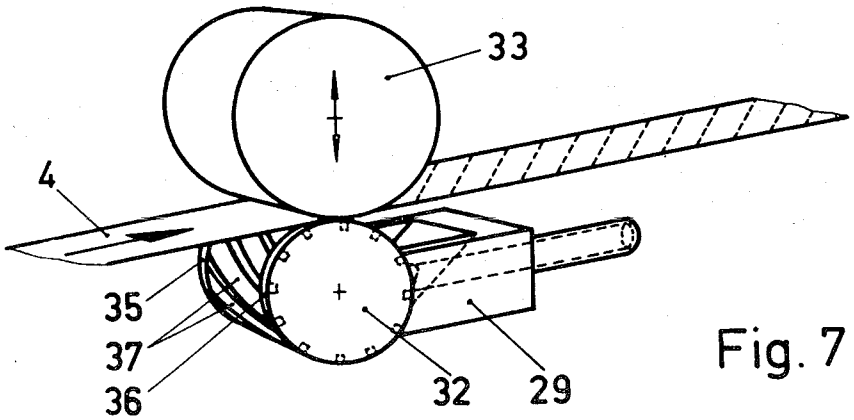
FIG. 7 is a perspective view of a second exemplified embodiment of means for applying adhesive substance to the covering paper strip.

FIGS. 6, 7 and 8 show different embodiments of means for applying adhesive substance to a covering strip 4. Identical means can also be used for the closing strip 21.

In the device illustrated in FIG. 6 the adhesive substance is applied to the covering strip 4 in a manner similar to that employed for transferring printer's ink in the letter-press process. The adhesive substance is delivered to an adhesive substance transfer roller 30 by means of a wide slot nozzle in an adhesive substance delivery device 29 and is thereafter transferred to the adhesive substance transfer ribs 31 of an applicator roller 32. Opposite to the rotatable applicator roller 32 there is disposed a rotatable contact roller 33 and the covering strip 4, consisting of highly porous paper, is passed between the two rollers 32 and 33 and in engagement therewith for the purpose of applying adhesive substance tracks 25. In this device hot melt adhesive is supplied under pressure to the adhesive substance delivery device 29. The quantity of adhesive substance is regulated by sliding the adhesive substance delivery device 29 relative to the surface of the roller 30 in the direction of the arrows 34.

In the device illustrated in FIG. 7 the adhesive substance is supplied to the covering strip 4 in a manner similar to that applied for transferring printer's ink in the intaglio printing process, namely by the adhesive substance being delivered into receptor grooves 37 of the applicator 32 from the adhesive substance delivery device 29 which bears on the side edges 35 and 36 of the applicator roller 32 and is then transferred to the surface of the covering strip 4. The amount of adhesive substance thus transmitted is defined by the depth of the adhesive substance receptor grooves 37. Hot melt adhesive is also supplied under pressure to the adhesive substance delivery device 29.

Figure 9:
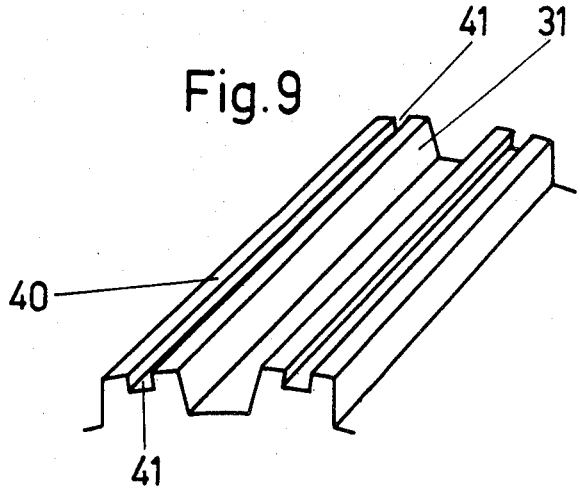
FIGS. 9 to 11 shows perspective views of modified embodiments of the applicator rib associated with the applicator roller which is illustrated in FIG. 6.

In the device illustrated in FIG. 8 a thermoplastic adhesive substance, for example polyvinyl acetate, is contained in a storage vessel 38. A delivery roller 39 is rotatably and sealingly disposed on the open front of the vessel and in the course of rotation delivers adhesive substance obtained from the storage vessel 38 to an adhesive substance transfer roller 30. From the adhesive substance transfer roller 30 the substance is transferred as in the device illustrated in FIG. 6. As can be seen by reference to FIG. 9 each transfer surface 40 of the adhesive substance transfer ribs 31 can be provided with an adhesive substance receptor groove 41 in order to improve the delivery of adhesive substance to the surface of the covering strip 4.

Figure 10:
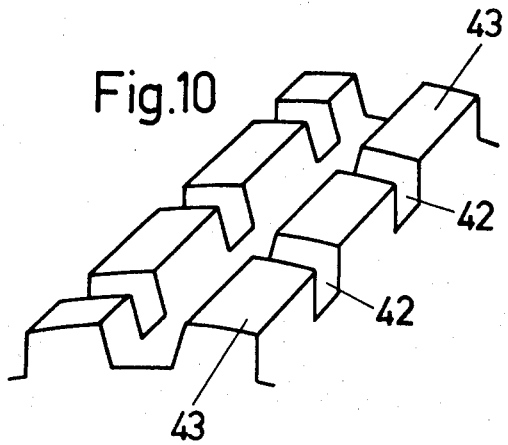
Figure 11:
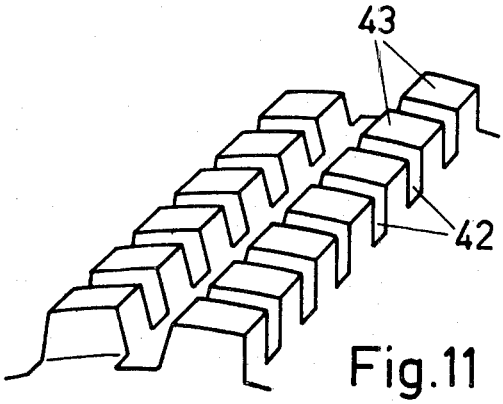
Figure 12:
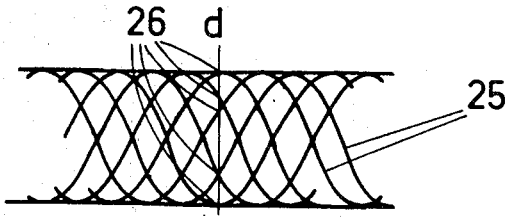
FIG. 12 is a plan view, analogous to FIG. 2, of a covering paper strip which is provided in a different manner with adhesive substance.

The adhesive substance transfer ribs 31 can be subdivided by recesses 42 into a plurality of rib portions 43 in order to obtain the delivery of adhesive substance as indicated in FIG. 12 on the right to which end the embodiment illustrated in FIG. 10 transfers the adhesive substance in the form of short lines and the embodiment illustrated in FIG. 11 transfers the adhesive substance in the form of dots to the surface of the covering strip.

Figure 13:
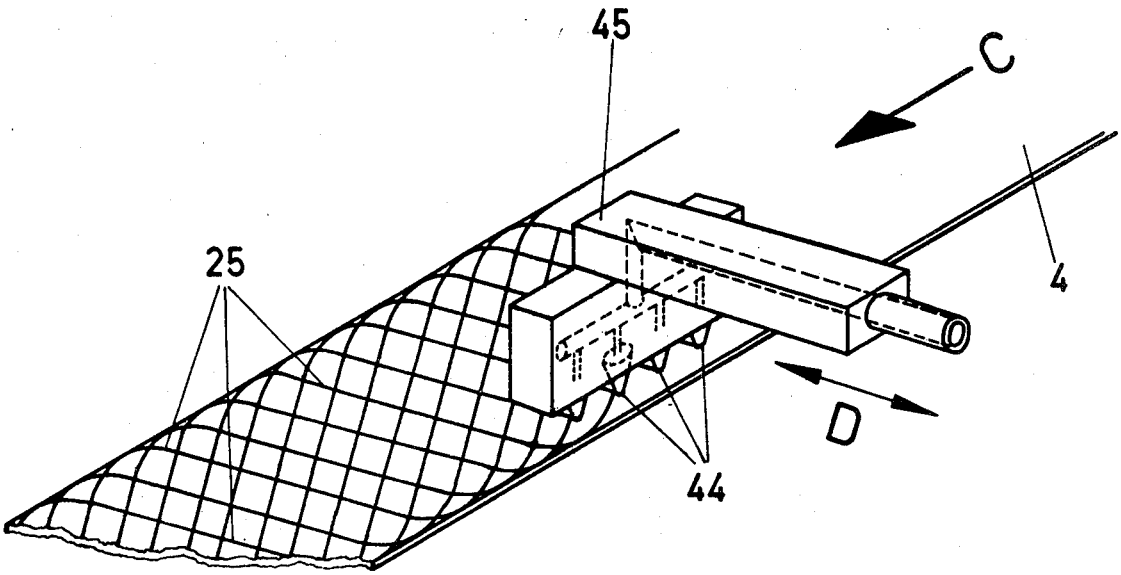
FIG. 13 is a perspective view of an arrangement for obtaining the adhesive substance coating illustrated in FIG. 12.

FIG. 12 discloses the means by which the adhesive substance is applied in the form of a plurality of successive sinusoidal curves on to the surface of the covering strip 4. Adhesive substance coating means suitable to this end are shown diagrammatically in FIG. 13. During the continuous forward motion of the covering strip in the direction of the arrow C a coating part 45 which has seven discharge nozzles 44 and is connected to the supply of adhesive substance is continuously reciprocated, perpendicular to the longitudinal extent of the covering strip and in the direction of the arrow D, so as to produce sinusoidal adhesive substance tracks 25. In selecting the distance between the discharge nozzles 44 from each other it is essential to ensure that at least three locations 26 of adhesive substance will be situated at any desired place of the covering strip 4 treated in this manner along a line of observation d which extends perpendicularly to the longitudinal orientation of the covering strip.

Figure 14:
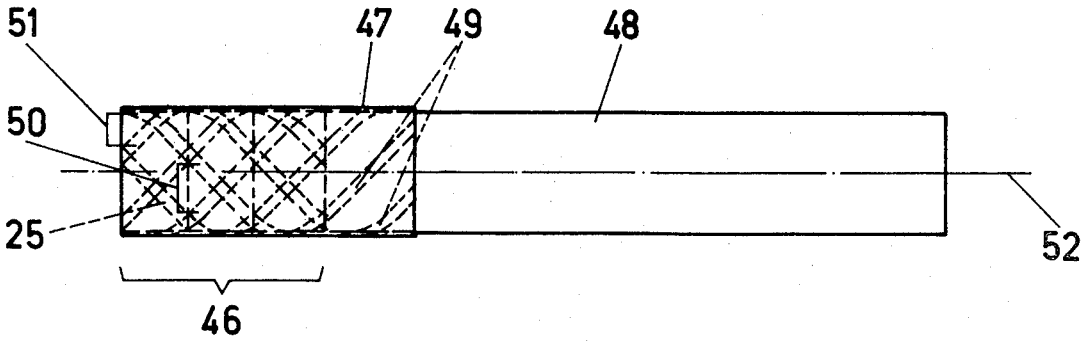
FIG. 14 is a partially sectioned side view of a filter cigarette produced in accordance with the invention.

FIG. 14 is a side view of a filter cigarette produced in accordance with the invention. As can be seen by reference to FIG. 14 the chamber filter 46 is connected to the tobacco unit or part 48 by means of a connecting strip 47. The connecting strip 47 in which the adhesive substance is applied along adhesive substance coating tracks 49 which extend at an angle to or perpendicular to the adhesive substance tracks 25 on the covering strip 4 so that in any random arrangement of the connecting strip 47 over the covering strip 4, those surfaces of the covering and connecting strip 4 or 47 which are free of adhesive substance are always the same in order that identical air permeability in the filter region is ensured for each cigarette. In the example illustrated in FIG. 14 the connecting strip 47 was provided with adhesive substance coating tracks 49 extending perpendicularly to the adhesive substance coating tracks 25 disposed on the covering strip 4, i.e., as can be seen by reference to FIG. 15, the adhesive substance was applied to the connecting strip 47 along equidistant straight lines 25 which extend at an angle $\beta$ of 135° with respect to the longitudinal extent of the connecting strip.

By virtue of the above-described construction of the chamber filter 46 the helical characteristic of the adhesive substance tracks 25 and the regions therebetween which are not adhesively joined reliably prevent free-flowing filter material escaping from the filter chamber 13 into the mouth of the smoker even if the chamber filter is severely deformed. In selecting the lateral spacing between adhesive substance tracks 25 it is essential to ensure that the tracks 25 are arranged sufficiently close side by side so that two end sides 50 and 51 of the helical regions formed between the adhesive substance tracks 25, which are free from any adhesive material applied thereto, do not overlap, as observed along the axial orientation of the cigarette filter 46, but are so spaced from each other, that any granulated filter particle which escapes from the chamber 13 into such a region free from any adhesive material cannot in any case reach the mouth of the smoker through any adhesive-material free region possibly disposed along a straight line parallel to the longitudinal filter axis. Only in this way is it possible to achieve reliable closure of the filter chamber 13 which is tightly filled with free-flowing filter material.

The adhesive substance tracks 49 can be applied to the connecting strip 47 by means of a device which can be constructed by analogy to the devices already illustrated in FIGS. 6 to 11; and 13 and it is merely necessary to ensure that a characteristic other than that of the adhesive substance coating tracks 25 disposed on the covering strip 4 is chosen for the adhesive substance covering tracks 49 on the connecting strip 47, so that the conditions according to the invention can be maintained. It has been found convenient and simple if the adhesive substance coating tracks 25 on the covering strip 4, and the adhesive substance coating tracks 49 on the covering strip 47 extend as illustrated in FIGS. 2 and 15, i.e. at an angle of about 45° to the longitudinal direction of the covering strip 4.

To obtain complete adhesive joining of its two side edges the connecting strip 47 can be provided with an adhesive strip 55 extending along its longitudinal direction in addition to the side edge 54 which overlaps the side edge 53 of the finished cigarette.

The place of the covering strip 4 to which the filter elements 1 are attached and the means by which the connecting strips 47 are wrapped around the covering strip 4 when the tobacco part 48 is connected to the filter unit 4 are completely immaterial because identical overlapping conditions will always obtain between the adhesive substance coating tracks 25 and 49 and the proportion of porous or perforated paper in the region of the covering strip and connecting strip 4 and 47 not covered by adhesive substance will always be of the same magnitude, that is to say the dilution of cigarette smoke flowing through this portion of the cigarette will always be of equal magnitude.

FIGS. 16 to 20 show other exemplified characteristics of adhesive substance coating tracks 25 on the covering strip and adhesive substance coating tracks 49 on the connecting strip.

We claim:

1. In a method of producing a filter cigarette from
a filter element,
a tobacco unit,
a porous or perforated sheathing strip,
a connecting strip, and
adhesive material,
the steps comprising:
applying the adhesive material to a portion of the sheathing strip along a set of first coating tracks in a preset direction,
subsequently adhesively wrapping the sheathing strip around the filter element, so as to constitute therewith a filter unit, said filter unit having a longitudinal axis, applying the adhesive material along portions of the connecting strip along a set of second coating tracks in a prearranged direction and, thereafter joining said filter unit to said tobacco unit, said preset and prearranged directions forming a prearranged angle with one another, so that in the event of any relative displacement of said strips along said longitudinal axis, said coating tracks in projection appear to intersect one another as viewed in a direction perpendicular to said longitudinal axis.

2. In a method as claimed in claim 1, wherein said prearranged angle is about 90°.

3. In a method as claimed in claim 1, wherein the first coating tracks are applied to said portion of the sheathing strip at approximately equally spaced intervals.

4. In a method as claimed in claim 1, wherein said preset and prearranged directions form first and second predetermined angles, respectively, with said longitudinal axis.

5. In a method as claimed in claim 1, wherein said connecting strip has a predetermined width, wherein said second coating tracks occur in a predetermined plane, and wherein said prearranged direction forms a predetermined angle with said longitudinal axis, said width and said predetermined angle being chosen so that a line at right angles to said longitudinal axis, and disposed in the same plane as said second coating tracks will intersect said second coating tracks at least three times.

6. In a method as claimed in claim 1, wherein said first coating tracks extend substantially parallel to one another.

7. In a method as claimed in claim 1, wherein said second coating tracks extend substantially parallel to one another.

8. In a method as claimed in claim 4, wherein said predetermined angle is about 45°, and wherein said first coating tracks extend along substantially straight lines.

9. In a method as claimed in claim 1, wherein each coating track has a predetermined width and is spaced from a neighboring coating track by a predetermined spacing exceeding said predetermined width by at least three times.

10. In a method as claimed in claim 1, wherein said adhesive material is a thermoplastic adhesive material from a group consisting of polyvinylacetate and hot-melt adhesive based on wax.

11. In an apparatus for producing a filter cigarette from a filter element, a tobacco unit, a porous or perforated sheathing strip, a connecting strip, and adhesive material, by applying the adhesive material to a portion of the sheathing strip along a set of first coating tracks in a preset direction, subsequently adhesively wrapping the sheathing strip around the filter element, so as to constitute therewith a filter unit, said filter unit having a longitudinal axis, applying the adhesive material along portions of the connecting strip along a set of second coating tracks in a prearranged direction, and thereafter joining said filter unit to said tobacco unit, said preset and prearranged directions forming a prearranged angle with one another, so that in the event of any relative displacement of said strips along said longitudinal axis, said coating tracks in projection appear to intersect one another as viewed in a direction perpendicular to said longitudinal axis, the improvement comprising:

applicator roller means, including adhesive substance receptor means disposed on the circumference of said applicator roller means for applying adhesive material to said sheathing and connecting strips along said first and second coating tracks, respectively.

12. An apparatus as claimed in claim 11, wherein said adhesive substance receptor means includes a plurality of transfer ribs.

13. An apparatus as claimed in claim 12, further comprising an adhesive substance transfer roller, said cover strip being engageable with one side thereof with said transfer ribs, and with the other side thereof with said transfer roller.

14. An apparatus as claimed in claim 13, further comprising adhesive substance delivery means operatively connected to said adhesive substance transfer roller.

15. An apparatus as claimed in claim 13, further comprising a container for storing said adhesive substance, said container being operatively connected to said transfer roller.

16. An apparatus as claimed in claim 15, further comprising a take-up roller in engagement with said transfer roller and operatively connected to said container.

17. An apparatus as claimed in claim 12, wherein each of said adhesive substance transfer ribs includes a transfer surface provided with a receptor groove for receiving said adhesive substance.

18. An apparatus as claimed in claim 12, wherein each of said transfer ribs is composed of a plurality of members extending in a predetermined direction and separated from one another by corresponding recesses.

19. An apparatus as claimed in claim 11, wherein said strips are movable in a transport direction, and said adhesive substance receptor means includes a plurality of discharge openings spaced from one another along said transport direction for discharging the adhesive material therefrom, said adhesive substance receptor means being reciprocally movable in a direction perpendicular to said transport direction.

20. A filter cigarette produced from a filter element, a tobacco unit, a porous or perforated sheathing strip, a connecting strip, and adhesive material, by applying the adhesive material to a portion of the sheathing strip along a set of first coating tracks in a preset direction.

subsequently adhesively wrapping the sheathing strip around the filter element, so as to constitute therewith a filter unit, said filter unit having a longitudinal axis, applying the adhesive material along portions of the connecting strip along a set of second coating tracks in a prearranged direction, and thereafter joining said filter unit to said tobacco unit, said preset and prearranged directions forming a prearranged angle with one another, within a range from an angle somewhat greater than 0° to an angle somewhat less than 360°.

21. A filter cigarette as claimed in claim 20, wherein said filter unit has a chamber containing freely-flowable filter material.

* * * * *